US011747033B2

(12) United States Patent
Clifton et al.

(10) Patent No.: US 11,747,033 B2
(45) Date of Patent: Sep. 5, 2023

(54) WIRELESS WALL THERMOSTAT

(71) Applicant: Orison, Inc., Cody, WY (US)

(72) Inventors: Eric Douglass Clifton, Cody, WY (US); Adrian Chernoff, Boulder (TZ)

(73) Assignee: Orison, Inc., Cody, WY (US)

( * ) Notice: Subject to any disclaimer, the term of this patent is extended or adjusted under 35 U.S.C. 154(b) by 46 days.

(21) Appl. No.: 17/468,553

(22) Filed: Sep. 7, 2021

(65) Prior Publication Data

US 2022/0113038 A1 Apr. 14, 2022

Related U.S. Application Data

(63) Continuation of application No. 15/604,418, filed on May 24, 2017, now Pat. No. 11,112,128, which is a (Continued)

(51) Int. Cl.

| | |
|---|---|
| ***F24D 19/10*** | (2006.01) |
| ***F24F 11/62*** | (2018.01) |
| ***F24F 11/30*** | (2018.01) |
| ***F24F 11/00*** | (2018.01) |
| ***F24F 11/63*** | (2018.01) |
| ***F24F 11/523*** | (2018.01) |
| ***F24F 11/57*** | (2018.01) |
| ***F24F 11/526*** | (2018.01) |
| ***F24F 110/10*** | (2018.01) |
| ***F24F 11/58*** | (2018.01) |

(Continued)

(52) U.S. Cl.

CPC ..... *F24D 19/10* (2013.01); *F24F 11/00* (2013.01); *F24F 11/30* (2018.01); *F24F 11/523* (2018.01); *F24F 11/526* (2018.01); *F24F 11/57* (2018.01); *F24F 11/62* (2018.01); *F24F 11/63* (2018.01); *F24F 11/52* (2018.01); *F24F 11/56* (2018.01); *F24F 11/58* (2018.01); *F24F 2110/10* (2018.01)

(58) Field of Classification Search

CPC . F24D 19/10; F24F 11/62; F24F 11/30; F24F 11/00; F24F 11/52

See application file for complete search history.

(56) References Cited

U.S. PATENT DOCUMENTS 2,860,212 A 11/1958 Andrus
5,839,654 A 11/1998 Weber
(Continued)

*Primary Examiner* — Henry T Crenshaw
(74) *Attorney, Agent, or Firm* — James Scott Nolan

(57) ABSTRACT

The wireless wall thermostat utilizes a push-contact mechanical system that allows a user to raise or lower the temperature within a space by applying a force on the top or bottom center of the front of the thermostat. The perpendicular force applied by the user generates a moment arm around pivot connectors, which rotates the thermostat clockwise or counter-clockwise. When rotated clockwise or counter-clockwise, contact buttons attached to the back of the thermostat come into contact with the trigger tabs of a stationary trigger plate mounted to a wall through use of an electromagnetic attraction between a steel disc and a magnet. When the trigger tabs press the contact buttons, the contact buttons send a signal to the central processing unit of the thermostat's internal circuit board to modulate the temperature setting. In addition, the wireless wall thermostat can be detachable by utilizing a magnetic release smart mount.

20 Claims, 8 Drawing Sheets

Related U.S. Application Data continuation of application No. 14/269,069, filed on May 2, 2014, now Pat. No. 9,677,776.

(60) Provisional application No. 61/818,578, filed on May 2, 2013.

(51) Int. Cl.
*F24F 11/56* (2018.01)
*F24F 11/52* (2018.01)

(56) References Cited

U.S. PATENT DOCUMENTS 6,810,307 B1 10/2004 Addy
8,195,313 B1 * 6/2012 Fadell ..... F24F 11/67 236/1 C
9,677,776 B2 6/2017 Clifton et al.
11,112,128 B2 9/2021 Clifton et al.
2003/0066897 A1 * 4/2003 Garner ..... G05D 23/1905 236/94
2004/0189701 A1 9/2004 Badt
2005/0040943 A1 2/2005 Winick
2005/0219209 A1 10/2005 Fleck et al.
2006/0196953 A1 9/2006 Simon et al.
2007/0228183 A1 10/2007 Kennedy et al.
2008/0006708 A1 1/2008 Gauger et al.
2008/0099568 A1 5/2008 Nicodem et al.
2010/0101854 A1 4/2010 Wallaert et al.
2011/0046792 A1 2/2011 Imes et al.
2011/0110023 A1 * 5/2011 Rylski ..... H05K 5/0243 361/679.01
2011/0257795 A1 10/2011 Narayanamurthy et al.
2012/0061480 A1 * 3/2012 Deligiannis ..... G05B 15/02 340/5.2
2012/0130546 A1 * 5/2012 Matas ..... B01D 46/0086 700/276
2012/0193437 A1 8/2012 Henry, Jr. et al.
2012/0248210 A1 10/2012 Warren et al.
2013/0105642 A1 5/2013 Marq
2013/0173064 A1 7/2013 Fadell et al.
2013/0338839 A1 * 12/2013 Rogers ..... F24F 11/57 700/278

* cited by examiner

WIRELESS WALL THERMOSTAT

RELATED APPLICATION

The present invention is a continuation of U.S. Utility patent application Ser. No. 15/604,418, filed on May 24, 2017 and entitled "Wireless Wall Thermostat," which is a continuation of U.S. Utility patent application Ser. No. 14/269,069, filed on May 2, 2014 and entitled "Wireless Wall Thermostat," which claims the benefit of priority to U.S. Provisional Application Ser. No. 61/818,578, filed on May 2, 2013, entitled Wireless Wall Thermostat.

FIELD OF THE INVENTION

The present invention relates generally to a wireless wall thermostat. The present invention is more particularly, but not exclusively, a wireless wall thermostat which utilizes push mechanics to raise or lower temperature. The push-contact mechanical system utilizes at least two pivot connectors, that allow the thermostat to rotate when a force is applied to the top or the bottom of the thermostat, and two contact buttons that activate by coming into contact with trigger tabs when the thermostat is rotated by said force. In addition, the wireless wall thermostat of the present invention can be detached from a wall and attached to a wall by use of a magnetic release smart mount. In addition, multiple wireless thermostats of the present invention can be used and integrated with a resource management and control system to control one or more areas in a closed area.

BACKGROUND OF THE INVENTION

The conservation of electricity, gas, and water has become a key concern across the globe. With the high cost of energy production, and the often devastating effects such production has on the environment, limiting the use of electricity and gas has never been more important. Many municipalities have in fact started to force conservation on their residents through regulation and legislation.

Clearly the majority of the population is not only mindful of the need for conservation, but willing to conserve their use of electricity, gas, and water for the benefit of the environment and associated cost savings. However, aside from the simplest acts of turning off lights and limiting use of water, heating and air conditioning, the ordinary consumer is not equipped to determine the actual results of their conservation efforts.

Studies show that a major contributor in reducing utility consumption and emissions is consumer awareness. Residents, builders and developers have an immediate need for products that can help them comply with the ever changing building codes for greenhouse gas emissions, energy and water conservation standards and guidelines. The market for conservation products has never been better, which means the demand for the wireless thermostat of the present invention has never been stronger.

The consumption of gas is greatly limited by the use of programmable thermostats which account for weekly occupancy and temperature setting variations. Traditionally, thermostats are fixtures built into the structure of a home. The placing of the thermostat is typically determined by the home builder. Once built into the structure, the thermostat cannot be easily repositioned. It would be advantageous for future inhabitants to have the option to reposition the thermostat based on their individual preference and need.

Single thermostat HVAC systems cannot accurately measure thermal variances in various climate control zones. Such inaccuracy can lead to inefficient energy consumption and system balance. Because a homeowner may not spend the majority of their time where the thermostat is permanently positioned, it would be advantageous to have a removable wireless thermostat (or multiple devices) which could be placed in any area determined by the home owner based on their current individual use and need.

Many existing home thermostats are built using mercury, a highly toxic substance, to measure temperature. Over time mercury leakage may occur, causing harm to the environment and potentially fatal exposure to humans. Furthermore, many thermostats are not user-friendly because their user interface may not be digital, graphic, or easily understood. It would be advantageous to use an environmentally friendly thermostat which poses no threat to the consumer or environment. It would be further advantageous to provide a removable wireless wall thermostat that is easy to use and comparatively cost effective.

By providing an ordinary resident the tools he or she needs to maximize their conservation efforts, overall consumption of electricity gas and water in the community will decrease. In addition to temperature sensing, it would also be advantageous to integrate a humidity sensor into the thermostat in order to present a more accurate description of the climate as experienced by the occupants.

SUMMARY OF INVENTION

The wireless wall thermostat of the present invention is an affordable residential and light commercial HVAC thermostat system that is simple and intuitive. The ability to strategically place multiple thermostats based on the use and need of the homeowner increases energy efficiency while helping consumers achieve conservation goals and maintain budgets. The removable wireless platform also allows users to create a network of multiple temperature sensors for more accurate temperature reading and control. By placing multiple wireless wall thermostats of the present invention in the home, a more accurate aggregated reading may be attained leading to more efficient HVAC system balancing. If only a single wireless wall thermostat of the present invention is desired, the magnetic release smart mount makes the device easily detachable allowing accurate climate control in any region of the home. Furthermore, humidity sensors are integrated with temperature sensors providing additional accuracy in climate control.

With an extremely easy to use E-Ink graphic user interface, the wireless wall thermostat of the present invention utilizes a pivoting display which facilitates intuitive temperature adjustment. Utilizing push mechanics, mounted buttons on the circuit board will allow the user to simply push the top or bottom of the thermostat to raise or lower the temperature respectively, without the use of small hard to see switches. E-Ink technology also allows for very low power consumption, when coupled with a rechargeable USB battery port the present invention is always operational yet still attains long lasting battery life. The wireless wall thermostat of the present invention also adopts the ZigBee communication standard to optimize low power usage and takes advantage of the mesh network communication ability.

BRIEF DESCRIPTION OF DRAWING FIGURES

The nature, objects, and advantages of the present invention will become more apparent to those skilled in the art after considering the following detailed description in connection with the accompanying drawings, in which like reference numerals designate like parts throughout, and wherein:

FIG. 1 is a system-level diagram of an integrated resource management and control system which the wireless wall thermostat of the present invention is designed to be integrated with detailing a residential energy and water monitor and control system including an intra-home communications network server, and interfaces to monitor and control utility inputs, and a central server (cloud) in communication with the home server and remote user stations;

Figure 9:
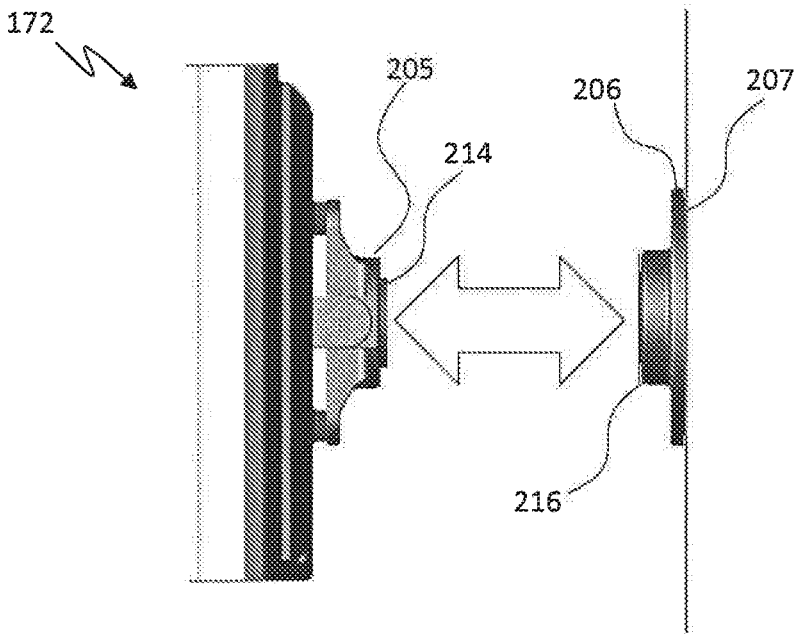
Figure 10:
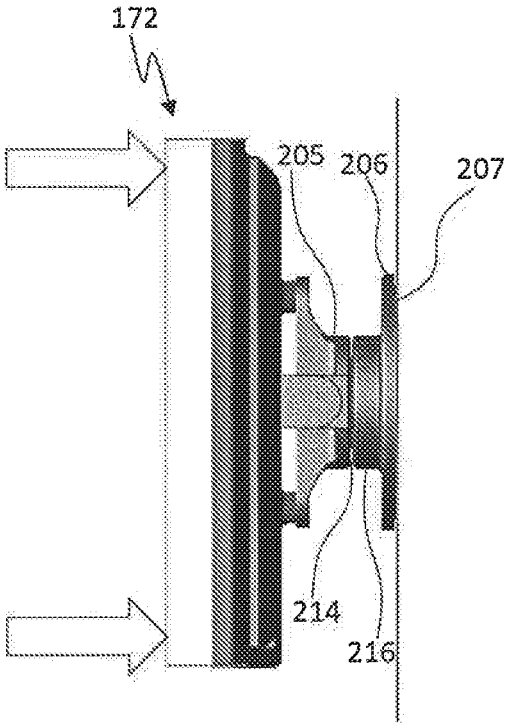
Figure 11:
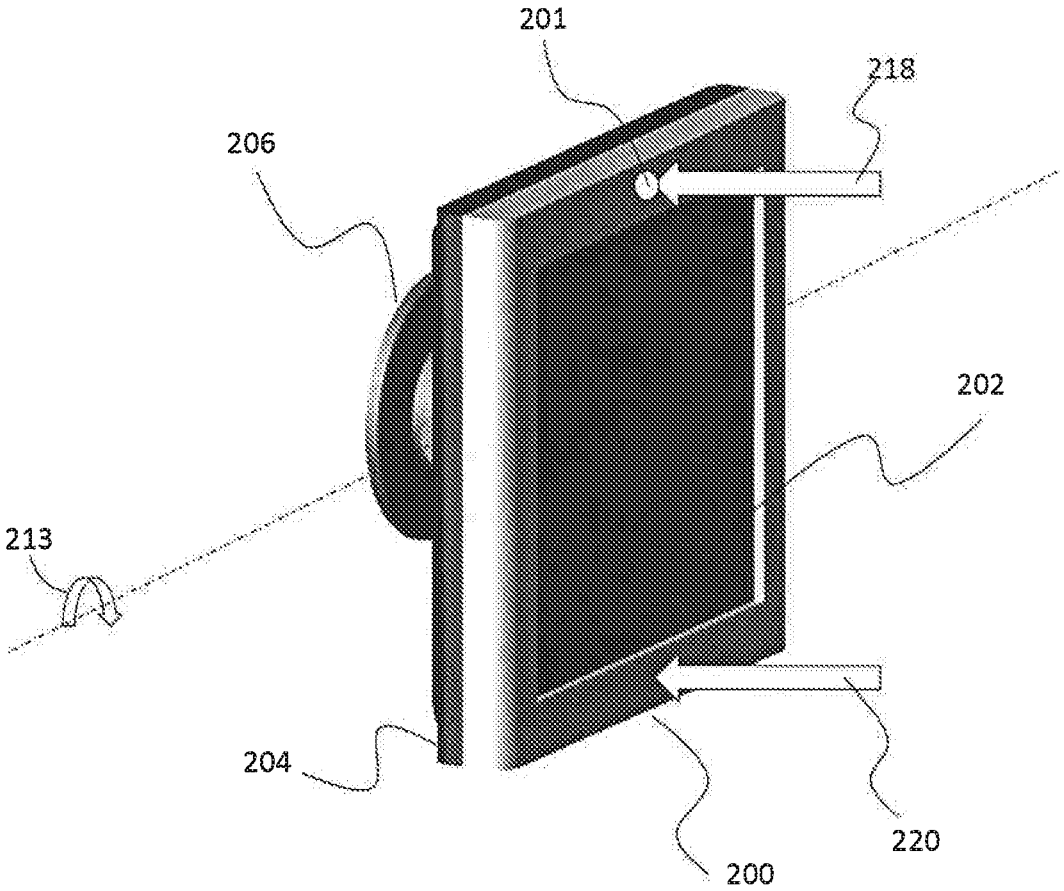
Figure 12:
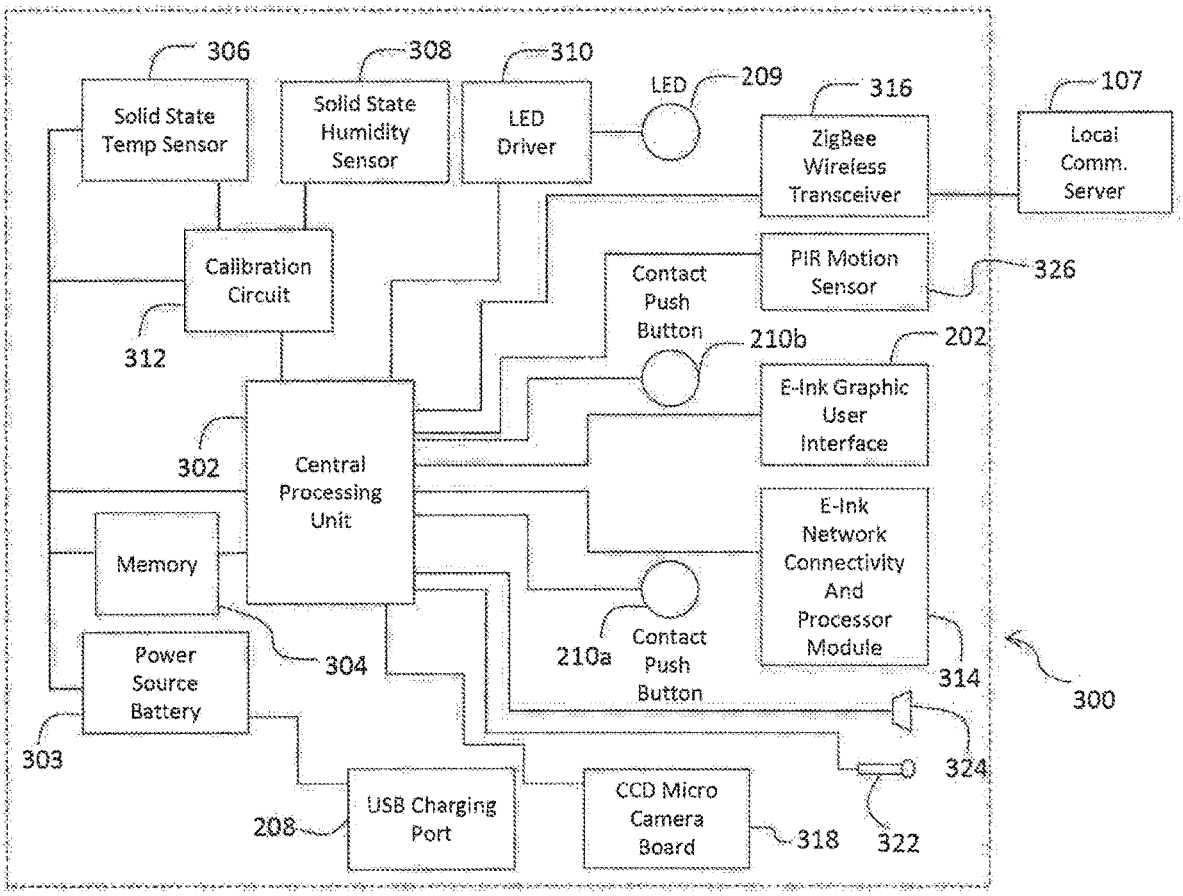
Figure 13:
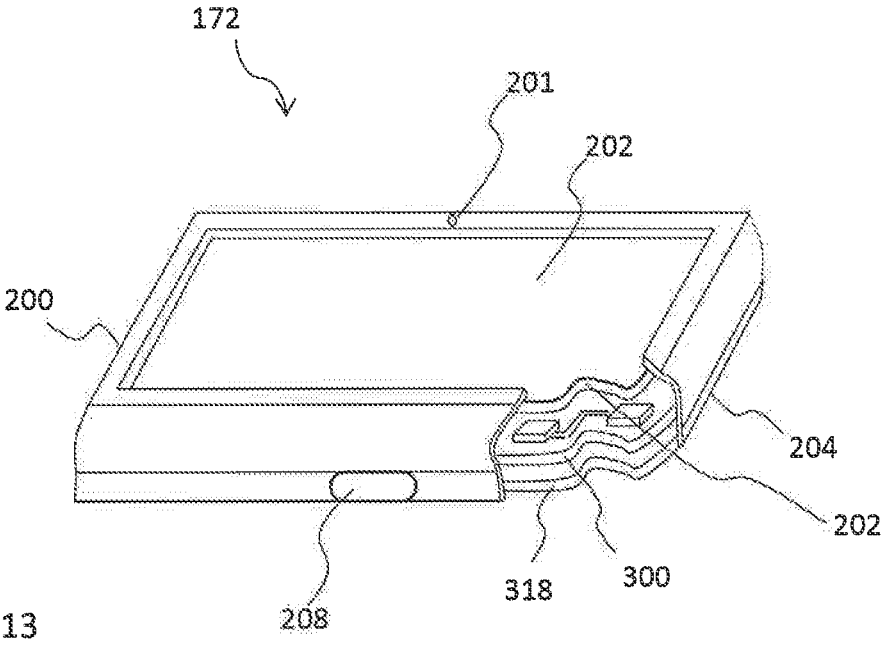

FIG. 9 demonstrates the dynamic dismount action of the magnetized wall mounting bracket in the right side view;

FIG. 10 shows the right side view of the present invention in the static mounted position;

FIG. 11 shows a left perspective view of the present invention having arrows depicting where the user interacts with the interface;

FIG. 12 shows a 1-line IC system level diagram of the circuit topology for the present invention; and FIG. 13 is a cut away bottom perspective view of the present invention having the front decor plate and the back plate housing the internal structure which includes the E-Ink GUI, and the motherboard chipsets, and an air gap layer;

DETAILED DESCRIPTION

Figure 1:
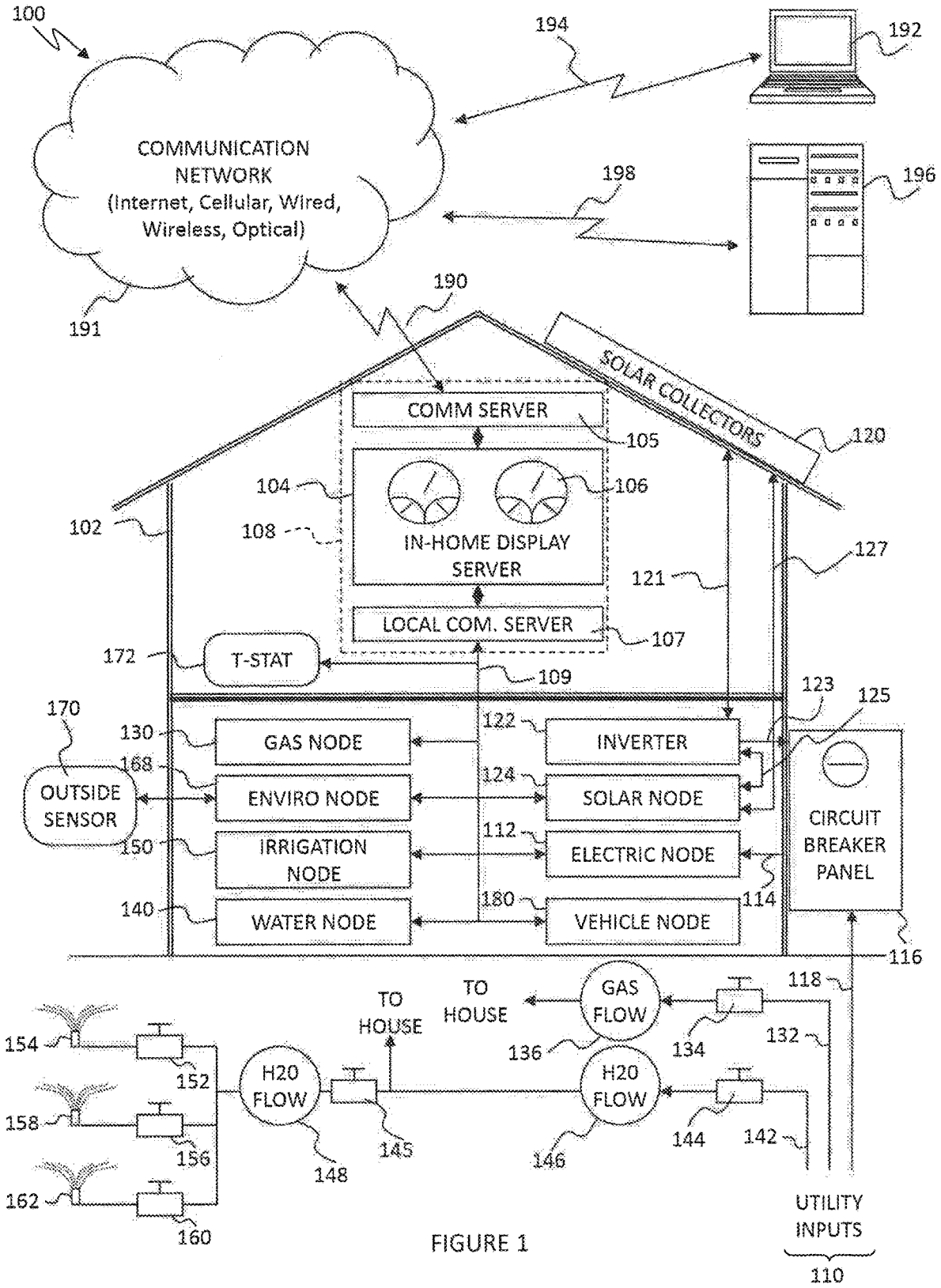

Referring initially to FIG. 1, a system-level diagram of the building management and control system with which the present invention is designed to be integrated is shown and generally designated 100. Home 102, in a preferred embodiment, includes an in-home display server 104 having an easily viewable display 106, in connection with a communication server 105 and a wireless server 107. Display server 104, communication server 105, and wireless server 107 may be separate devices, as shown, or may be operationally grouped together in a control station 108 (shown in dashed lines).

Communication server 105, in a preferred embodiment, facilitates the communication between the control station 108, and all external components of the system. The communication methods incorporated into communication server 105 include, but are not limited to, broadband wired communication using known or proprietary communication techniques, and broadband wireless communication using known communication techniques, such as cellular, GSM, CDMA, 3G and 4G wireless networks, and other wireless communication systems available.

Wireless server 107 provides for a wireless communication link 109. In a preferred embodiment, communication link 109 is consistent with the ZigBee communication standard. Zigbee is a suite of high level communication protocols using small, low-power digital radios based on the IEEE 802.15.4-2003 standard. In addition, ZigBee coordinators can be provided to facilitate communication within the ZigBee communication link, and to interface to a wired communication system.

While this communication protocol is particularly well suited for the wireless wall thermostat of the present invention, it is to be appreciated that other existing wireless, wired, and power line communication (PLC) communication protocols may be incorporated herein without departing from the scope of the present invention.

Utility inputs 110 are supplied to home 102, and may include electricity, gas, and water. Each of these utility inputs 110 is separately measured and monitored by the resource management and control system of the present invention 100. For instance, electric node 112 is in wireless communication with wireless server 107 through link 109, and in electrical connection 114 with circuit breaker panel 116. Electrical utility input 118 enters breaker panel 116 and is distributed throughout home 102 as is standard in the industry. As will be described in greater detail below, the electric node 112 utilizes voltage and current sensors to monitor the condition and consumption of electrical energy, and relates this data through wireless communication link 109 to the wireless server 107.

Home 102 may be equipped with solar collectors 120. In a preferred embodiment, these solar collectors are solar panels of the photovoltaic (PV) type. A solar panel, also referred to as a photovoltaic module or photovoltaic panel, is a packaged interconnected assembly of solar cells, also known as photovoltaic cells. A solar panel is used as a component in a larger photovoltaic system to collect radiation energy from the sun and convert it to electricity for commercial and residential applications. Because a single solar panel can only produce a limited amount of power, many installations contain several panels to generate increased levels of power.

Solar collector 120 is in electrical communication through connection 121 with an inverter 122 which converts the typically direct current (DC) generated by the solar panel, to an alternating current (AC) at a voltage consistent with the electrical input 118 from utility inputs 110. Several inverters suitable for the present invention are available from a number of manufacturers, and provide an AC output voltage to circuit breaker panel 116 through connection 123. Typically, this AC output voltage is integrated into the panel 116 through an isolation breaker (not shown) to allow for isolating the solar collectors 120 and inverter 122 from the breaker panel 116.

Solar node 124 is in wireless communication with wireless server 107 through link 109, and monitors and controls the function of solar collectors 120 and inverter 122 through communication connections 127 and 125, respectively. This monitoring may include, but not be limited to, monitoring the electrical output (current and voltage) of collectors 120, monitoring the proper operation of inverter 122 and the condition of an isolation breaker if provided, and the isolation or electrical disconnection of the solar collectors 120 from circuit breaker panel 116.

Gas node 130 is in wireless communication with wireless server 107 through link 109, and monitors the rate of consumption of gas from gas input 132. Gas input 132 passes through a valve 134 and through gas flow meter 136 to home 102. The control of gas valve 134 and the monitoring of gas flow meter 136 are accomplished by gas node 130, and the condition and results are reported through wireless communication link 109 to wireless server 107.

Water node 140 is in wireless communication with wireless server 107 through link 109, and monitors the pressure, temperature, and rate of consumption of water from water input 142. Water input 142 passes through valve 144 and primary flow meter 146. The output from primary flow meter 146 branches off to home 102 and secondary valve 145. Secondary valve 145 feeds irrigation valves 152, 156, and 160 through secondary flow meter 148. The combination of primary flow meter 146 and secondary flow meter 148 provides for an accurate measurement of the total water supplied (primary flow meter 146), and the portion of that water that is supplied to the irrigation system (secondary flow meter 148). For instance, water through secondary flow meter 148 can be supplied to valve 152 and irrigation zone 154, valve 156 and irrigation zone 158, and valve 160 and irrigation zone 162. By actuating valve 144, the water supply can be shut off entirely. Alternatively, by actuating valves 152, 156, and 160, or just valve 145, the water supply to the irrigation system can be entirely shut off.

Irrigation node 150 is in wireless communication with wireless server 107 through link 109, and controls valves 152, 156, and 160. In a preferred embodiment, these valves provide control to irrigation zones 154, 158 and 162. It is to be appreciated that three (3) valves is merely exemplary, and that any number of irrigation zones, and associated valves, can be incorporated into the present invention. Irrigation node 150 receives instructions from control station 108 to open and close the valves according to a watering schedule described below in greater detail.

Environmental node 168 is in wireless communication with wireless server 107 through link 109, and may include an exterior-located sensor array 170. For instance, in a preferred embodiment, interior-located environmental node 168 may monitor the temperature and humidity throughout home 102, while the exterior-located sensor array 170 may provide exterior temperatures, humidity, radiation levels, or other energy-related measurements.

Thermostat 172 is in wireless communication with wireless server 107 through link 109, and in electrical connection with the heating and cooling systems of home 102. As is standard with typical heating and cooling installations, home 102 may be divided into various zones, and thermostat 172 may be relocated by the occupant to take measurements throughout various zones. Alternatively, multiple thermostats 172 may be utilized throughout home 102 to provide zone-specific temperature control. Also, home 102 may be equipped with multiple heating and cooling appliances and each may be controlled by a separate thermostat.

Vehicle node 180 is in wireless communication with wireless server 107 through link 109, and may be provided to monitor the electrical consumption of a vehicle, such as an electric vehicle, or a charge-requiring hybrid.

Control station 108, including wireless server 107 and display server 104, is in communication with remote user stations 192 and a central server 196. More specifically, control station 108, through communication link 190, passes through a communication network 191 and a communication link 194 to remote user stations 192. Similarly, control station 108, through communication link 190, passes through communication network 191 and communication link 198 to a central server 196.

In a preferred embodiment, communication link 190, 194, and 198 and communication network 191 include web-based communication protocol passed over the internet. It is to be appreciated, however, that other communication protocols and systems known in the art may be utilized without departing from the present invention.

As shown in FIG. 1, only one home 102, one remote user station 192, and one central server 196 are shown. It is to be appreciated that this depiction is merely for discussion purposes, and that any number of homes 102, any number of remote user stations 192, and perhaps multiple central servers 196 may be incorporated into the building management and control system with which the present invention may be integrated.

Figure 2:
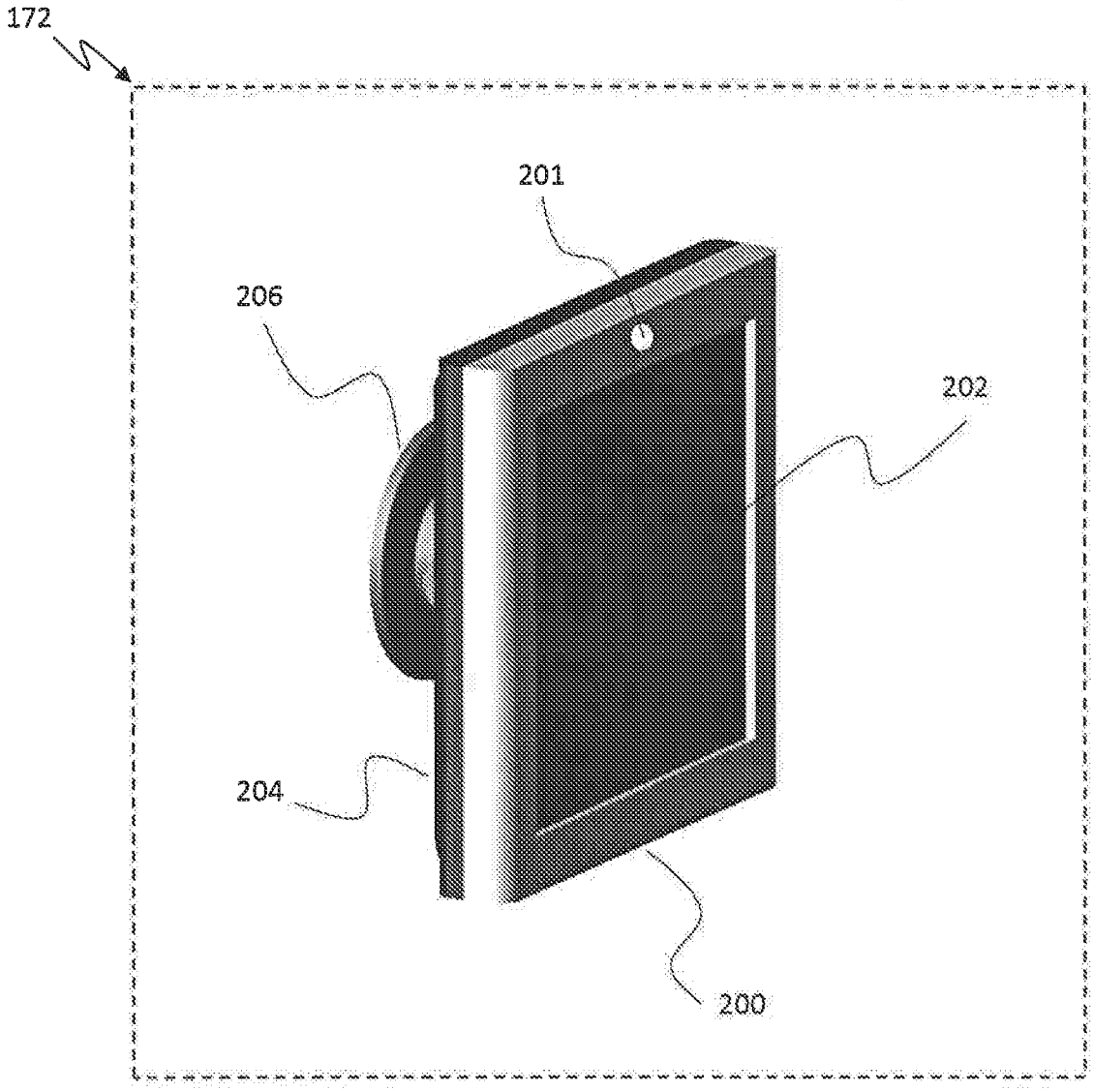
FIG. 2 shows a left perspective view of a preferred embodiment of the wireless wall thermostat of the present invention having a front decor plate attached to a back plate with an E-Ink graphic user interface (GUI) and a detachable magnetic wall mount.

Referring now to FIG. 2, thermostat 172 is depicted in a preferred embodiment. As shown in FIG. 2, there is only one thermostat 172; however, it is to be appreciated that this depiction is merely for discussion purposes, and that multiple thermostats 172 may be utilized throughout home 102 to provide zone-specific temperature control and higher smart grid efficiency.

Figure 3:
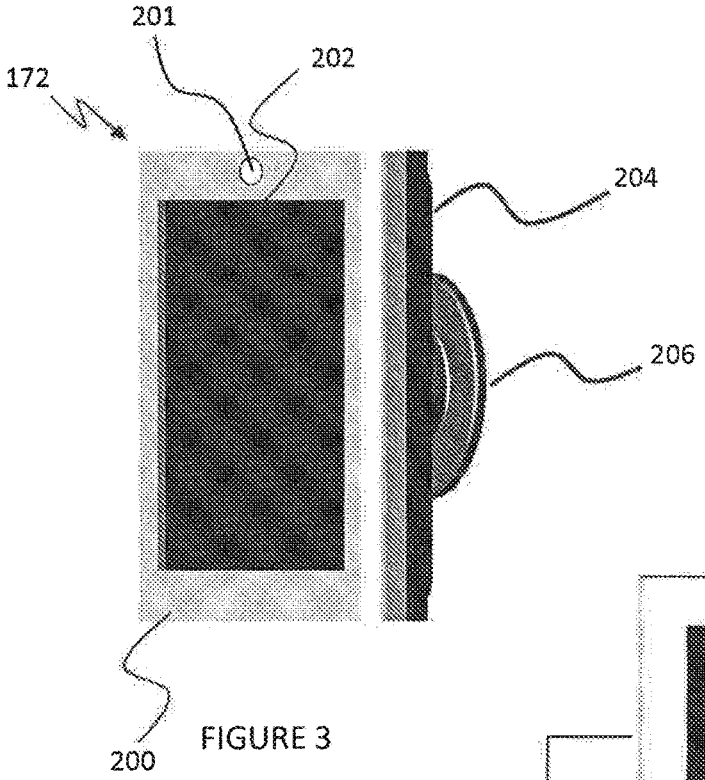
FIG. 3 shows the right perspective view of the wireless wall thermostat of the present invention and is a mirror image of FIG. 2 also having a front decor plate and a back plate with an E-Ink GUI and a detachable magnetic wall mount.
Figure 4:
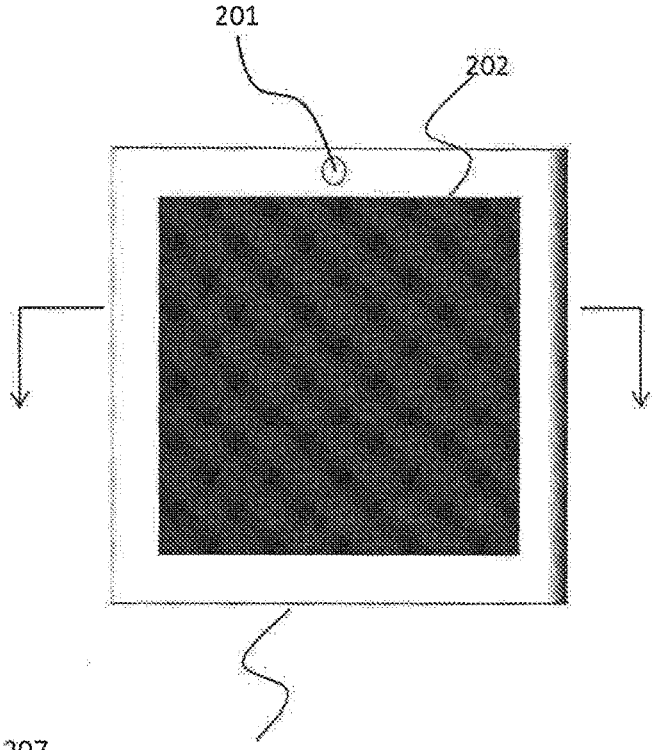
FIG. 4 shows the front view of the wireless wall thermostat of the present invention having the front decor plate surrounding the E-ink GUI.

Referring now to FIGS. 3 and 4, front decor plate 200 is rectangular shaped with rigid aluminum textured plastic in a metallic style finish and mounted to back plate 204 and wall bracket 206. Back plate 204 and front decor plate 200 provide a housing for the E-Ink GUI 202 and the internal circuit board 300 (see FIG. 12). In a preferred embodiment, front decor plate 200 encompasses the perimeter of the E-Ink GUI 202 as displayed in FIG. 4. Front decor plate 200 frames the E-Ink GUI 202 which is positioned slightly below the inside perimeter of front decor plate 200 frame. With respect to the front view shown in FIG. 4, the front decor plate 200 and the E-Ink GUI 202 form one smooth plane from the perspective of the user. Back plate 204, along with the other rear plastic parts including wall bracket 206, may be fabricated in black or dark grey plastic. E-Ink GUI 202 may be fabricated with glass or plastic.

Figure 5:
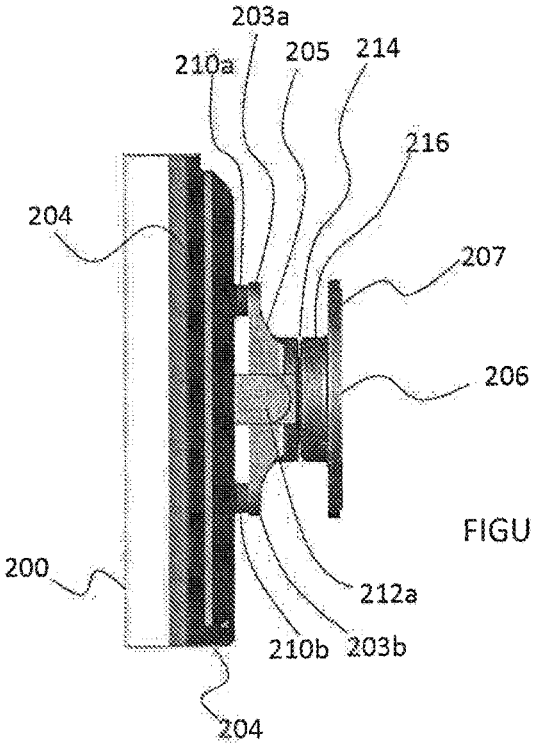
FIG. 5 shows the right side view of the device having a front and back plate, a magnetized wall bracket connected to a trigger plate, and a pivot connector engaged in a trigger socket with a trigger tab assembled on top of a contact button.

Now referring to FIG. 5, a wall adhesive 207 is affixed to wall bracket 206. In a preferred embodiment, wall adhesive 207 is an adhesive sticker. In use, the consumer peels a cover from wall adhesive 207 and sticks the wall bracket 206 with wall adhesive 207 to a wall in any desired location. In a preferred embodiment, the consumer may also install multiple wall adhesives 207 and wall brackets 206 in multiple locations. A magnet 216 is affixed to wall bracket 206 on the opposite side of wall adhesive 207. The magnet 216 may be any type of magnet known in the industry, including neodymium, strong enough to hold the thermostat of the present invention 172 in place while allowing the thermostat 172 to be easily removed when pulled on by a user. In order to provide the electromagnetic attraction to actuate the mounting mechanism, steel disc 214 is attached to the center of trigger plate 205 facing magnet 216. Once assembled, steel disc 214 and trigger plate 205 can be easily attached and detached from the wall via the assembled magnetized wall mounting bracket 216, 207, and 206 described in detail infra (refer to FIG. 9).

Figure 6:
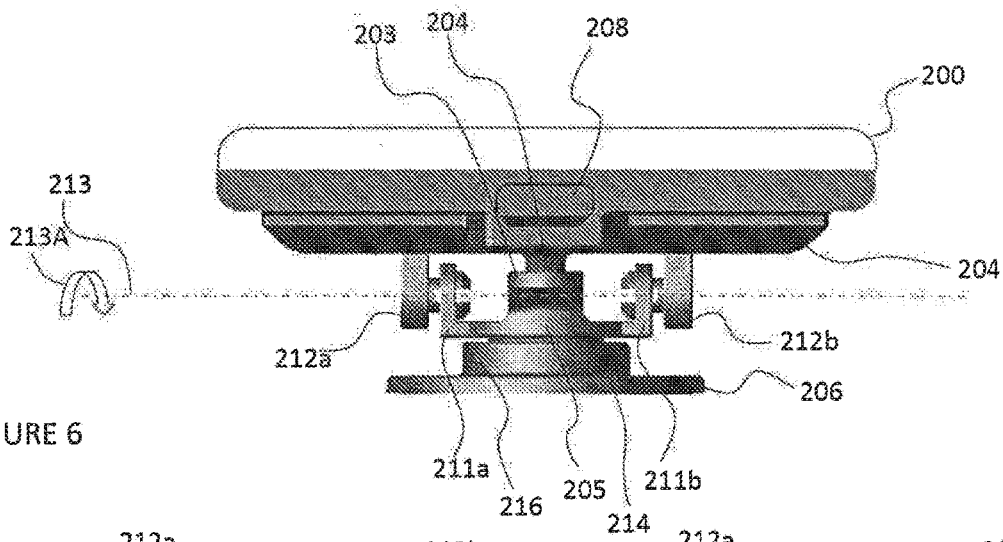
FIG. 6 shows the bottom view of the wireless wall thermostat of the present invention in mounted position having a USB power/charging port centered on the back plate with the wall mounting bracket in the attached configuration.

As shown in FIG. 6, trigger plate 205 is mounted to pivot connectors 212*a* and 212*b* by snapping the connectors 212 into their respective trigger sockets 211*a* and 211*b*. Pivot connectors 212 and trigger plate 205 may be constructed in dark grey or black aluminum textured plastic. Trigger plate 205 is centered on back plate 204 such that contact buttons 210*a* and 210*b* (see FIG. 5) are directly underneath the trigger tabs 203*a* and 203*b*. Trigger sockets 211 align with the pivot connectors 212.

USB power port 208 is centered on the bottom side of the back plate 204. The x-axis 213 illustrates the rotational axis about which the pivot connectors 212 rotate within the trigger sockets 211 in order to activate contact buttons 210. Trigger tabs 203 comprise the top and bottom portion of trigger plate 205. A detailed description of the operation of the contact buttons 210 is discussed infra with FIG. 11.

Figure 7:
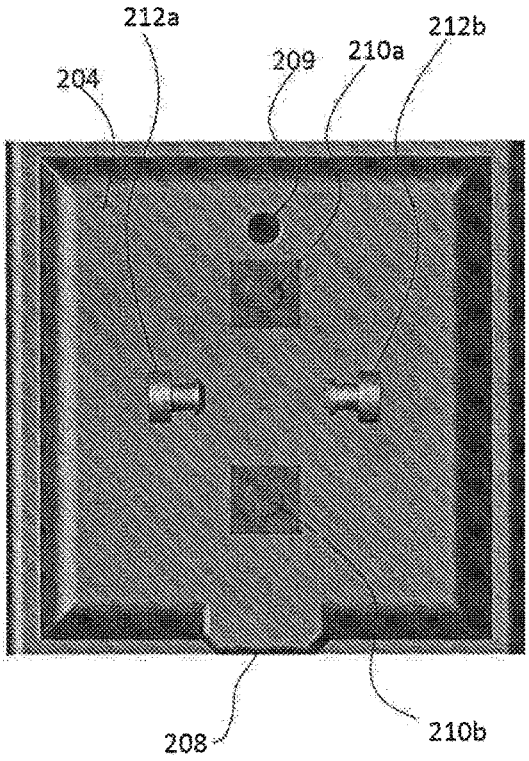
FIG. 7 shows the pre-assembled back view of the wireless wall thermostat of the present invention having the back plate attached to pivot connectors and the contact buttons mounted alongside a LED and a USB Power/Charging port.

Referring now to FIG. 7, pivot connectors 212 snap in back plate 204 via the prefabricated slits (not shown in this Figure) in back plate 204. Trigger sockets 211 are fabricated midway between the top and bottom of trigger plate 205 and are positioned symmetrically off the center axis to align with pivot connectors 212. Contact buttons 210, LED 209, and USB power port 208 are also prefabricated into back plate 204 and are mounted into circuit board 300 (see FIG. 12). Contact buttons 210 and pivot connectors 212 are positioned such that trigger sockets 211 can be positioned to snap into pivot connectors 212, and trigger tabs 203 can activate contact buttons 210, which is described in detail in conjunction with FIG. 8.

Figure 8:
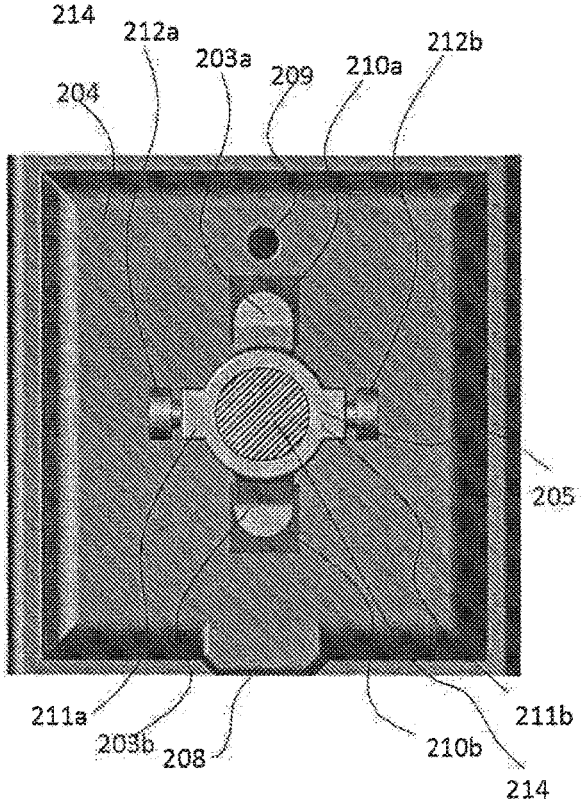
FIG. 8 shows an assembled back view having trigger plate attached to snap in pivot connectors and steel disc affixed to the trigger plate in addition to FIG. 7.

Referring now to FIG. 8, trigger plate 205 snaps into place by inserting pivot connectors 212 into trigger sockets 211. Trigger sockets 211 and trigger tabs 203 take the shape of a cross with an ellipse superimposed on the center of the cross where steel disc 214 is affixed. In the preferred embodiment, the positioning of trigger plate 205 and contact buttons 210 along with pivot connectors 212 collectively form the push-contact mechanical system the wireless wall thermostat of the present invention 172 utilizes to actuate user input which is described in detail in conjunction with FIG. 11.

Referring now to FIGS. 9 and 10, the detachable action of the wireless wall thermostat of the present invention is depicted between the assembled wall bracket 206, 216, and 207, the steel disc 214, and trigger plate 205. The electromagnetic attraction between steel disc 214 and magnet 216 will allow the present invention to remain firmly secure in any desired position, while still allowing any user to easily overcome the attractive force by pulling thermostat 172 off the assembled wall bracket 206, 216, and 207. FIG. 10 depicts the wireless wall thermostat of the present invention 172 in the static mounted position where the electromagnetic attraction between magnet 216 and steel disc 214 keeps the wireless wall thermostat of the present invention 172 firmly in place.

Now referring to FIG. 11, the easy control pivoting display action is demonstrated. In order to raise or lower the temperature, the user would apply a top force 218 or bottom force 220 of front decor plate 200 represented in FIG. 11 by the solid arrows. The perpendicular force applied by the user generates a moment arm around the pivot connectors 212 (not shown); this applied torque will cause the pivot connectors 212 (not shown) to rotate around x-axis 213 in either a clockwise or counter-clockwise direction depending on the location of the applied force. Trigger plate 205 (not shown), however, does not rotate along with pivot connectors 212 (not shown) as it is firmly attached to wall bracket 206 via magnet 216. Trigger tabs 203 activate contact buttons 210. Pivot connectors 212 rotate within trigger sockets 211 while trigger plate 205 remains stationary. Because pivot connectors 212 are firmly affixed into back plate 204, front decor plate 200 and back plate 204 also rotate uniformly when this torque is applied. As back plate 204 rotates, contact buttons 212 become forced on either trigger tab 203*a* or 203*b* and are thereby activated sending a signal to the central processing unit 302 to modulate the temperature setting.

The method of adjusting the wireless wall thermostat of the present invention 172 to raise or lower the temperature may be in multiple design embodiments. It is to be appreciated that the method of action by movement that gives physical feedback through the user is merely exemplary and no limitation as to the selection or incorporation of alternatively functioning devices is intended. For example, the front of the display might just have two buttons for up or down, the back may pivot, swivel, rotate, slide, or glide in any mechanical movement, or free moving motion.

FIG. 12 is a block diagram for the typical circuit topology of the wireless wall thermostat of the present invention's 172 motherboard and is generally labeled 300. Motherboard 300 includes a USB power and charging port 208 and a battery 303, which generate all voltage levels required for operation of the present invention. A central processing unit 302 provides digital processing for the motherboard 300 and, in a preferred embodiment, is a microcontroller having onboard program and dynamic storage memory, such as the PIC18Fxxxx family of microcontrollers. Static memory unit 304 can also be incorporated in order to facilitate the central processing unit's 302 speed-sensitive cache. It is to be appreciated that the incorporation of such microcontrollers and memory into the motherboard 300 of the wireless wall thermostat of the present invention 172 is merely exemplary of a preferred embodiment, and no limitation as to the selection or incorporation of alternatively functioning computing devices is intended.

To provide visual indicators of the present inventions operational state, LED driver 310 receives input from central processing unit 302 to illuminate status LED indicator 209. Contact buttons 210 actuate user commands into the central processing unit 302, which then relays the commands to local communication server 107 via ZigBee wireless module 316. The ZigBee wireless module 316 may also act as a transponder to provide real time system information to local communication server 107.

The present invention includes both a temperature sensor 306 and a humidity sensor 308. These coupled inputs can provide the wireless wall thermostat of the present invention 172 with real-time local environmental information that can be utilized to optimize energy use and realize the largest savings possible. Temperature sensor module 306 communicates real time information to the central processing unit 302 via calibration module 312.

Generally, the forward bias voltage across the semiconductor junction of the temperature sensor circuit 306 has a very constant change in voltage with temperature over a wide temperature range if the electrical current through the junction is held constant. Because the constant increases with current and varies from device to device, some method is needed to calibrate the temperature sensor 306. Calibration module 312 will take the temperature signal and send the normalized information to central processing unit 302. A humidity sensor module 308 will also feed real time input into central processing unit 302 via calibration module 312.

Using hygroscopic polymer films to sense humidity is one simple approach to integrating humidity sensors in CMOS/MEMS.

An optional camera 320, speaker 324, and microphone 322 may be utilized in thermostat 176 and are fully contemplated. Camera 320, speaker 324, and microphone 322 interface to CPU 312. Camera 320 may be a charge-coupled device (CCD), a complementary metal oxide semiconductor (CMOS) device, or any other type of camera suitable for mounting onto a circuit board. Camera's 320 field of view is through camera hole 201 located on the top of front decor plate 200. Microphone 322 and speaker 324 are mounted on motherboard 300. Camera 320 interfaces with control station 108 through CPU 312. In a preferred embodiment, In-Home Display Server 104 can display the image generated from camera 320 along with audio from microphone 322. Audio from the in home display server 104 is delivered to thermostat 172 through communication link 109, which sends the audio signal to CPU 302, then to speaker 324. The image and audio from camera 320 and microphone 322 may be transmitted to user station 192 or central server 196 through communication links 190, 194, and 198 and communication network 191. In an embodiment, thermostat 172 may be used for two-way video and audio communication between thermostat 172 and in home display server 104 or user station 192.

Also included in thermostat 172 is a motion sensor 326 for detecting a user's presence in front of or neat thermostat 172. Motion sensor 326 may be either a passive or active infrared sensor. When a presence is detected, thermostat 172 may energize the E-Ink GUI 202 to display the current temperature and humidity conditions. Further, thermostat 172 may be configured to send a signal to in home display server 104, remote user 192, or central server 196 when motion sensor 326 detects a presence. Thermostat 172 may be further configured to turn on camera 320 and microphone 322 and transmit those signals to in home display server 104, remote user 192, or central server 196 when motion sensor 326 detects a presence.

A variety of temperature and humidity configurations and signal conditioning circuits can be incorporated into the motherboard of the present invention 300 and are fully contemplated herein. Such signal conditioning circuits and alternative configurations are well known in the art and intended to remove spurious noise and signal glitches that would otherwise contribute to erroneous measurements.

The E-Ink GUI 202 displays all system information to the user and receives information from the E-Ink network connectivity and processor module 314, which is in communication with the central processing unit 302. Central processing unit 302 communicates with ZigBee wireless transceiver/transponder 316. As described supra, in a preferred embodiment, transceiver/transponder 316 is a ZigBee communication module and establishes a bidirectional mesh communication network when multiple units are utilized. Because each ZigBee implementation is established with a unique serial number and identifier, it is capable of distinguishing any thermostat 172 from any other thermostat 172 when multiple thermostats are used. It is to be appreciated that incorporation of a ZigBee communication module onto motherboard 300 of the wireless wall thermostat of the present invention 172 is merely exemplary of a preferred embodiment and no limitations as to the selection or incorporation of alternative functionally equivalent or similar communication interfaces such as PLC is intended.

FIG. 13 is a cut-away bottom perspective view of front decor plate 200 and back plate 204 of the wireless wall thermostat of the present invention 172. This depiction reveals the internal layers of motherboard 300, E-Ink GUI 202, and an air gap layer 318. USB power port 208 (not shown) is internally connected to battery 303 (not shown) on motherboard 300. As illustrated, front decor plate 200 and back plate 204 encompass the internal electronics and user interface. The E-Ink GUI 202 is installed inside the perimeter of the front decor plate 200 and is the top layer of the internal infrastructure. The E-Ink GUI 202 is in electrical connection with the motherboard 300 which includes all the network connectivity and chipsets. Motherboard 300 is constructed underneath the E-Ink GUI 202 and comprises the middle layer of the internal infrastructure. Motherboard 300 utilizes air gap 318 in order to input accurate temperature and humidity measurements. It is to be appreciated that incorporation of this configuration of the internal infrastructure of the present invention is merely exemplary of a preferred embodiment and no limitations as to the selection or incorporation of alternative functionally equivalent or similar internal infrastructure configurations is intended.

The system architecture of the wireless wall thermostat of the present invention 172 provides many user benefits. For instance, the E-Ink GUI 202 provides users with a simple to understand interface that is intuitive, easily viewable, and located in any desired room to accurately sense HVAC conditions. By providing the user with the ability to reposition the wireless wall thermostat of the present invention and provide real time measurements of the desired location in home 102, the user can take immediate steps to minimize consumption. The capability of integrating multiple wireless wall thermostats of the present invention 172 into a home 102 allows the user to implement specific zone tuning opportunities leading to increased efficiency. This unique experience gives the user confidence, convenience, and an intuitive way to adjust the temperature. The wireless wall thermostat of the present invention 172, unlike any other invention, allows a user to track energy consumption and minimize usage in order to save money and protect our environment.

In an alternative embodiment, E-Ink GUI 202 is coupled with a touch screen (not shown) layered over GUI 202 and allows for touch screen control of all thermostat 172 functions and set points. A touch screen controller (not shown) interfaces with the touch screen and CPU 302. CPU 302 then coordinates with E-Ink GUI 202 to sense touches on the touch screen associated with a specific action displayed on GUI 202.

While there have been shown what are presently considered to be preferred embodiments of the present invention, it will be apparent to those skilled in the art that various changes and modifications can be made herein without departing from the scope and spirit of the invention.

We claim:

1. A thermostat system for modulating a temperature within an environment, the system comprising:

a wireless portable, thermostat assembly having a temperature setting, the wireless portable thermostat including:

a housing having a back bounding surface coupled to a plurality of opposed boundary members forming a perimeter, together the back bounding surface and the perimeter encase a display device having a graphical user interface for displaying one or more conditions pertinent to an environment, the housing defining a cavity for retaining various electronic components of the wireless portable thermostat, and having one or more first contacts positioned on a surface of the housing;

a thermostat retained within the housing and having the temperature setting, the thermostat being configured for modulating a setpoint for the temperature setting, a printed circuit board retained within the housing and in communication with the display, the printed circuit board for coupling various of the electronic components one with another, the printed circuit board comprising:

a plurality of sensors, each sensor configured for determining at least one of the one or more conditions pertinent to the environment, the plurality of sensors including:

a temperature sensor for determining a temperature of the environment, and a humidity sensor for determining a humidity of the environment, a central processing unit (CPU) for receiving a temperature modulation signal and in response thereto generating a control command for instructing a HVAC unit to initiate a cooling or heating protocol for modulating the temperature within the environment, a memory coupled to the CPU, the memory configured for storing one or more onboard programs;

a wireless communications module coupled to the CPU, the wireless communications module including a transceiver configured for being coupled to the HVAC unit through a wireless communications network, the wireless communications module for wirelessly communicating the control command to the HVAC unit, a rechargeable power source coupled to the PCB and configured for supplying energy to the various electronic components of the wireless portable thermostat; and at least one wall mount having a surface for retaining the portable, wireless thermostat assembly in a moveable manner, the surface of the wall mount having one or more second contacts, together the wireless portable, thermostat assembly and the wall mount form a mechanical temperature assembly for generating the temperature modulation signal for increasing or decreasing the temperature setting of the thermostat in response to a physical force being applied to the housing of the thermostat, the physical force resulting in a rotational movement of the thermostat housing relative to the wall mount such that at least one of the one or more first contacts engage at least one of the one or more second contacts, thereby generating the temperature modulation signal.

2. The thermostat system in accordance with claim 1, wherein the mechanical temperature assembly comprises a push-contact configured for facilitating the movement of the housing relative to the wall mount from a rest position to either a first or a second position on the wall mount, wherein movement of the housing to the first position results in the generation of a temperature modulation signal comprising a rise in temperature instruction, and movement of the housing to the second position results in the generation of a temperature modulation signal comprising a lowering of a temperature instruction.

3. The thermostat system in accordance with claim 2, wherein the push-contact comprises a set of activation contacts, a first activation contact being positioned at a third position on the housing opposite the first position on the wall mount, and a second activation contact being positioned at a fourth position on the housing opposite the second position on the wall mount, the first and second activation contacts being separated by a first distance.

4. The thermostat system in accordance with claim 3, wherein the back bounding surface comprises a set of trigger contacts including a first trigger contact and a second trigger contact, each of the first and second trigger contact being in communication with the PCB, the first and second trigger contacts being separated from one another by a second distance, the second distance corresponding to the first distance.

5. The thermostat system in accordance with claim 4, wherein the movement of the housing relative to the wall mount brings one or more of the first and second activation contacts into communication with one or more of the first and second trigger contacts thereby generating the temperature modulation signal.

6. The thermostat system in accordance with claim 5, wherein the plurality of sensors comprises a motion sensor, the motion sensor being configured for detecting a movement of a person relative to the thermostat, and in response to the movement powering on the wireless portable thermostat.

7. A wireless thermostat system, the system comprising:

at least one wall mount for retaining thermostat assemblies in a releasable manner; and a wireless, portable thermostat assembly for modulating a temperature within an environment, the wireless, portable thermostat assembly comprising:

a backplate for moveably retaining the portable, wireless thermostat assembly, and further configured for associating the portable, wireless thermostat assembly with the at least one wall mount, a housing having a back bounding surface coupled to a plurality of opposed boundary members forming a perimeter portion, together the back bounding surface and the perimeter portion encase a graphical user interface having a display for displaying one or more conditions pertinent to an environment, the back surface and perimeter portion defining a cavity for retaining various electronic components of the wireless portable thermostat;

a thermostat retained within the housing and having a temperature setting, the thermostat being configured for modulating a setpoint for the temperature setting, a printed circuit board, coupled to the thermostat, and in communication with the display, the circuit board for coupling various of the electronic components one with another, the circuit board comprising:

a plurality of sensors, each sensor configured for determining at least one of the one or more conditions pertinent to the environment, the plurality of sensors including:

a temperature sensor for determining a temperature of the environment, and a humidity sensor for determining a humidity of the environment, a central processing unit (CPU) for receiving a temperature modulation signal and in response thereto generating a control command for instructing a HVAC unit to initiate a cooling or heating protocol for modulating the temperature within the environment in accordance with the setpoint, a memory coupled to the CPU, the memory configured for storing one or more onboard programs, a wireless communications module coupled to the CPU, the wireless communications module including a transceiver configured for being coupled to the HVAC unit through a wireless communications network, the wireless communications module for wirelessly communicating the control command to the HVAC unit, and a rechargeable power source coupled to the circuit board and configured for supplying energy to the various electronic components of the wireless portable thermostat, wherein together the backplate and the back bounding surface of the housing form a mechanical temperature modulation assembly for generating the temperature modulation signal for increasing or decreasing the temperature setpoint of the thermostat in response to a physical force being applied to the housing of the thermostat assembly, the physical force resulting in movement of the thermostat assembly housing relative to the backplate.

8. The thermostat system in accordance with claim 7, wherein the mechanical temperature assembly comprises a push-contact configured for facilitating the movement of the housing relative to the backplate from a rest position to either a first or a second position on the backplate, wherein movement of the housing to the first position results in the generation of a temperature modulation signal comprising a rise in temperature instruction, and movement of the mechanical temperature assembly to the second position results in the generation of a temperature modulation signal comprising a lowering of a temperature instruction.

9. The thermostat system in accordance with claim 8, wherein the push-contact is configured for facilitating the movement of the housing relative to the backplate from rest to the first and second positions by a pivotal movement inwards or outwards relative to a top edge of the backplate or a rotational movement relative to a left or righthand side edge of the backplate.

10. The thermostat system in accordance with claim 9, wherein the push-contact is positioned on the backplate and comprises a set of activation contacts, a first activation contact being positioned at a third position on the housing opposite the first position on the wall mount, and a second activation contact being positioned at a fourth position on the housing opposite the second position on the wall mount, the first and second activation contacts being separated by a first distance.

11. The thermostat system in accordance with claim 5, wherein the movement of the housing relative to the backplate brings one or more of the first and second activation contacts into communication with one or more of the first and second trigger contacts thereby generating the temperature modulation signal.

12. The thermostat system in accordance with claim 11, wherein the back bounding surface comprises a set of trigger contacts including a first trigger contact and a second trigger contact, each of the first and second trigger contact being in communication with the PCB, the first and second trigger contacts being separated from one another by a second distance, the second distance corresponding to the first distance.

13. A wireless thermostat system comprising:

at least one wall mount for retaining a thermostat assembly in a releasable manner; and a wireless, portable thermostat assembly for modulating a temperature within an environment, the wireless, portable thermostat assembly comprising:

a housing including a back bounding surface coupled to a plurality of opposed boundary members forming a perimeter portion, together the back bounding surface and the perimeter portion encase a graphical user interface having a display for displaying one or more conditions pertinent to an environment, the back surface and perimeter portion defining a cavity for retaining various electronic components of the wireless portable thermostat;

a thermostat retained within the housing and having a temperature setting, the thermostat being configured for modulating a setpoint for the temperature setting, a circuit board, coupled to the thermostat, and in communication with the display, the circuit board for coupling various of the electronic components one with another, the circuit board comprising:

a plurality of sensors, each sensor configured for determining at least one of the one or more conditions pertinent to the environment, a central processing unit (CPU) for receiving a temperature modulation signal and in response thereto generating a control command for instructing a HVAC unit to initiate a cooling or heating protocol for modulating the temperature within the environment in accordance with the setpoint, a memory coupled to the CPU, the memory configured for storing one or more onboard programs, a wireless communications module coupled to the CPU, the wireless communications module including a transceiver configured for being coupled to the HVAC unit through a wireless communications network, the wireless communications module for wirelessly communicating the control command to the HVAC unit, and a rechargeable power source coupled to the circuit board and configured for supplying energy to the various electronic components of the wireless portable thermostat, wherein together the wall mount and the back surface of the housing form a mechanical temperature modulation assembly for generating the temperature modulation signal for increasing or decreasing the temperature setpoint of the thermostat in response to a physical force being applied to the housing of the thermostat assembly, the physical force resulting in movement of the thermostat assembly housing relative to the backplate.

14. The thermostat system in accordance with claim 13, wherein the mechanical temperature assembly comprises a push-contact configured for facilitating the movement of the housing relative to the wall mount from a rest position to either a first or a second position on the wall mount, wherein movement of the housing to the first position results in the generation of a temperature modulation signal comprising a rise in temperature instruction, and movement of the housing to the second position results in the generation of a temperature modulation signal comprising a lowering of a temperature instruction.

15. The thermostat system in accordance with claim 14, wherein the push-contact is configured for facilitating the movement of the housing relative to the wall mount from rest to the first and second positions by a pivotal movement or a rotational movement.

16. The thermostat system in accordance with claim 15, wherein the push-contact is positioned on the wall mount and comprises a set of activation contacts, a first activation contact being positioned at a third position on the housing opposite the first position on the wall mount, and a second activation contact being positioned at a fourth position on the housing opposite the second position on the wall mount, the first and second activation contacts being separated by a first distance.

17. The thermostat system in accordance with claim 16, wherein the back bounding surface comprises a set of trigger contacts including a first trigger contact and a second trigger contact, each of the first and second trigger contact being in communication with the PCB, the first and second trigger contacts being separated from one another by a second distance, the second distance corresponding to the first distance.

18. The thermostat system in accordance with claim 17, wherein the movement of the housing relative to the wall mount brings one or more of the first and second activation contacts into communication with one or more of the first and second trigger contacts thereby generating the temperature modulation signal.

19. The thermostat system in accordance with claim 13, wherein the plurality of sensors comprises a motion sensor, the motion sensor being configured for detecting a movement of a person relative to the thermostat, and in response to the movement powering on the wireless portable thermostat.

20. The thermostat system in accordance with claim 14, wherein the wireless, portable thermostat assembly comprises a camera configured for capturing an image of a person within a field of view of the wireless, portable thermostat assembly.

* * * * *